US010798990B2

(12) United States Patent
L'Hermet

(10) Patent No.: US 10,798,990 B2
(45) **Date of Patent: *Oct. 13, 2020**

(54) SANDAL WITH MAGNETICALLY CONNECTED UPPER STRAPS

(71) Applicants: Julien L'Hermet, Fujian (CN); Nils Ostberg, Aix en Provence (FR)

(72) Inventor: Julien L'Hermet, Fujian (CN)

(73) Assignees: Julien L'Hermet, Xiamen, Fujian (CN); Nils Ostberg, Aix en Provence (FR)

( * ) Notice: Subject to any disclaimer, the term of this patent is extended or adjusted under 35 U.S.C. 154(b) by 0 days.

This patent is subject to a terminal disclaimer.

(21) Appl. No.: 16/362,182

(22) Filed: Mar. 22, 2019

(65) Prior Publication Data

US 2019/0261726 A1 Aug. 29, 2019

Related U.S. Application Data

(63) Continuation-in-part of application No. PCT/CN2019/076119, filed on Feb. 26, 2019, and a (Continued)

(51) Int. Cl.
*A43B 3/12* (2006.01)
*A43B 3/24* (2006.01)
(Continued)

(52) U.S. Cl.
CPC ..... *A43B 3/122* (2013.01); *A43B 1/0054* (2013.01); *A43B 3/0073* (2013.01); *A43B 3/10* (2013.01); *A43B 3/244* (2013.01)

(58) Field of Classification Search
CPC .. A43B 3/244; A43B 3/16; A43B 3/12; A43B 3/122; A43B 3/125; A43B 3/127;
(Continued)

(56) References Cited

U.S. PATENT DOCUMENTS 2,260,055 A * 10/1941 Reardon ..... H01F 7/0252 81/451
5,253,394 A * 10/1993 Morita ..... A41F 1/002 24/303

(Continued)

*Primary Examiner* — Shaun R Hurley
*Assistant Examiner* — Bao-Thieu L Nguyen

(57) ABSTRACT

A sandal with a magnetically connected upper straps uses a sandal sole, multiple strap-attachment coupler, and a removable upper to enable a user to modify the sandal's appearance. The strap-attachment couplers are fasteners which are used to attach the removable upper to the multilayered sole. To accomplish this the strap-attachment couplers includes a connector-receiving receptacle and an upper-fastening mechanism. The removable upper includes multiple strap segments, each of which is connected to a connector insert. Inserting the connector insert into the connector-receiving receptacle enables the upper-fastening mechanism to become coupled to the connector inserts, thus tethering the removable upper to the sandal sole. Additionally, the strap-attachment couplers are distributed across the insole, such that the strap-attachment couplers enable the user to create a desired type of sandal.

18 Claims, 7 Drawing Sheets

Related U.S. Application Data continuation-in-part of application No. 15/905,081, filed on Feb. 26, 2018, now abandoned, said application No. PCT/CN2019/076119 is a continuation-in-part of application No. 15/905,081, filed on Feb. 26, 2018, now abandoned.

(51) Int. Cl.
*A43B 3/10* (2006.01)
*A43B 3/00* (2006.01)
*A43B 1/00* (2006.01)

(58) Field of Classification Search
CPC ..... A43B 3/0073; A43B 3/10; A43B 13/36; Y10T 24/32
USPC ..... 36/100
See application file for complete search history.

(56) References Cited

U.S. PATENT DOCUMENTS 5,572,772 A * 11/1996 Morita ..... A45C 13/1076 24/303
5,896,684 A * 4/1999 Lin ..... A43B 3/103 36/101
6,418,643 B1 * 7/2002 Yang ..... A43B 3/0078 36/101
6,430,846 B1 * 8/2002 Lin ..... A43B 3/122 24/640
6,675,448 B2 * 1/2004 Revel ..... A41F 1/002 24/303
9,072,338 B1 * 7/2015 Kostecky ..... A43B 7/26
9,603,410 B2 * 3/2017 McNamara-Schwartz ..... A43B 3/0078
10,206,450 B1 * 2/2019 Krastev ..... A43B 3/24
2003/0145490 A1 * 8/2003 Tsai ..... A43B 3/122 36/15
2004/0143998 A1 * 7/2004 Yang ..... A43B 3/24 36/100
2004/0187346 A1 * 9/2004 Bianchi ..... A43B 3/122 36/11.5
2004/0230139 A1 * 11/2004 Chang ..... A43B 1/0054 601/15
2005/0016019 A1 * 1/2005 Smith ..... A43B 3/103 36/11.5
2005/0167992 A1 * 8/2005 Lo ..... E05C 19/16 292/251.5
2005/0193534 A1 * 9/2005 Paganelli ..... A43B 3/244 24/640
2006/0080813 A1 * 4/2006 Pearce ..... A43B 3/122 24/662
2006/0112596 A1 * 6/2006 Chan ..... A43B 3/103 36/100
2006/0112597 A1 * 6/2006 Stern ..... A43B 3/103 36/101
2011/0154694 A1 * 6/2011 Yamane ..... A43B 3/242 36/30 R
2011/0277502 A1 * 11/2011 Welikson ..... A44B 1/14 63/1.18
2012/0216429 A1 * 8/2012 Bastida ..... A43B 3/122 36/25 R
2013/0019496 A1 * 1/2013 Mizrahi-Shapiro ..... A43B 1/0027 36/11.5
2013/0091732 A1 * 4/2013 Mendoza ..... A43B 3/0078 36/100
2014/0196307 A1 * 7/2014 Fremming ..... A43B 1/0027 36/15
2014/0352171 A1 * 12/2014 Hillyer ..... A43B 3/0078 36/11.5
2015/0040434 A1 * 2/2015 Perkins ..... A43B 1/0054 36/101
2015/0237950 A1 * 8/2015 Caldwell ..... A43B 3/24 36/100
2017/0119086 A1 * 5/2017 Hillyer ..... A43B 3/244
2018/0035745 A1 * 2/2018 Fremming ..... A43B 3/122
2019/0191814 A1 * 6/2019 Stuempfig ..... A43B 1/0081
2019/0200697 A1 * 7/2019 Salmon ..... A43B 3/103
2019/0261726 A1 * 8/2019 L'Hermet ..... A43B 3/122

* cited by examiner

SANDAL WITH MAGNETICALLY CONNECTED UPPER STRAPS

The current application is a continuation-in-part (CIP) application of a U.S. non-provisional application Ser. No. 15/905,081 filed on Feb. 26, 2018.

FIELD OF THE INVENTION

The present invention relates generally to a sandal. More particularly, the present invention relates to a sandal with a detachable upper portion.

BACKGROUND OF THE INVENTION

The common sandal has been around for millennia and has modified in innumerable ways. Sandals offer a quick and easy way to protect a user's feet without preventing airflow. Additionally, sandals of various shape and style can be worn to complement the user's outfit. One drawback to the common sandal is that the sandal is often manufactured and distributed in a single style or color that cannot be changed. This forces the fashion-conscious user to purchase multiple pairs of sandals which will match with various outfits. Another problem with sandals is that the soles often wear out before the upper straps do. This forces the user to purchase a new pair of sandals simply because the sole is no longer usable.

The present invention addresses these issues by providing a sandal with an upper that can be detached and reattached as the user desires. This functionality enables the user to switch the sandal's upper portion depending on the situation. The present invention achieves this functionality by integrating detachable fasteners into the straps of the sandal's upper and the sandal's sole. The user can insert the ends of the straps into the fastening mechanism that are integrated into the sole to connect the upper to the sole. The present invention provides a fastening system that does not become disengaged due to incidental forces and can only be disengaged by the user. To accomplish this the present invention makes use of a unibody or multilayered sole and magnetic couplers. Both of which are designed to remain tethered to the upper until the user detaches the upper from the sole.

DETAIL DESCRIPTIONS OF THE INVENTION

All illustrations of the drawings are for the purpose of describing selected versions of the present invention and are not intended to limit the scope of the present invention.

Referring to FIG. 1 through FIG. 7, the preferred embodiment of the present invention, the sandal with magnetically connected upper straps, is a sandal that enables a user to remove and replace the upper as desired. The term upper is used herein to refer to the straps of the sandal that are positioned over the user's foot and serve as retention members that keep the user's foot within the sandal. The present invention makes use of magnetic connectors to form detachable connections between the upper and the sandal's sole. This enables the user to modify the look or function of the sandal when necessary.

Figure 1:
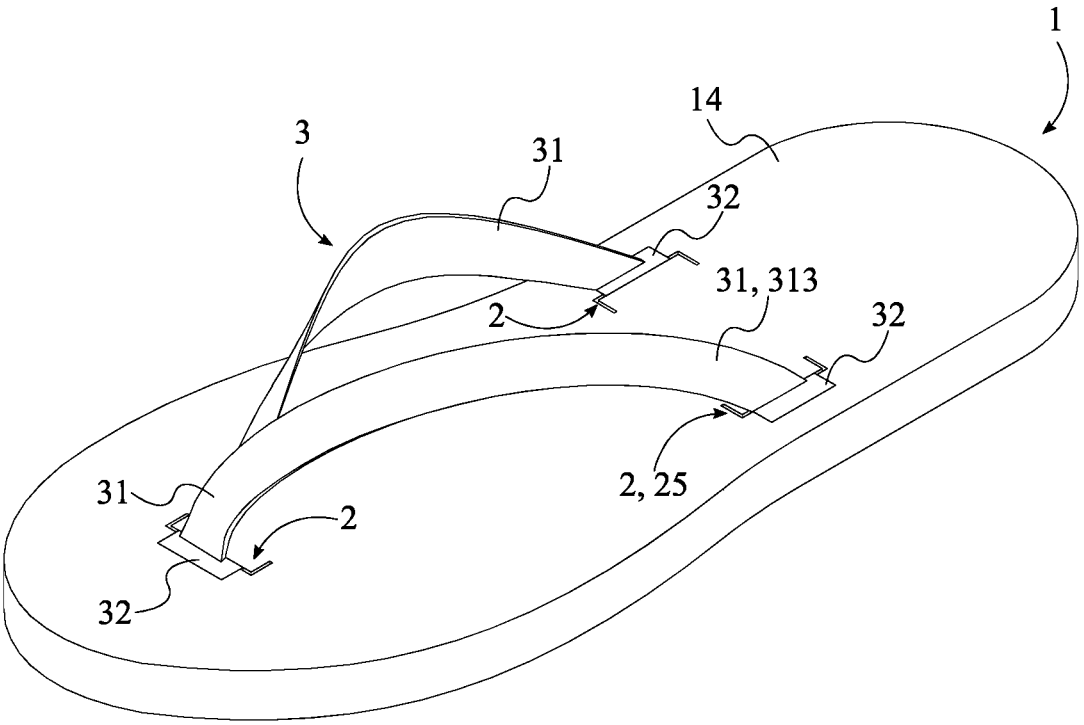
FIG. 1 is a perspective view of the present invention with the sandal sole being of unibody construction.

Referring to FIG. 1, to achieve the above-described functionality, the present invention makes use of a multi-component sandal with detachable parts. Specifically, the present invention comprises a multilayered sole 1, a plurality of strap-attachment couplers 2 and a removable upper 3. The sandal sole 1 is a unibody sole that provides comfort to the user and is designed to promote a desired aesthetic. Each of the plurality of strap-attachment couplers 2 is a receptacle that functions as a fastener which is used to form a detachable connection between the removable upper 3 and the sandal sole 1. To accomplish this, each of the plurality of strap-attachment couplers 2 comprises a connector-receiving receptacle 21 and an upper-fastening mechanism 22. The upper-fastening mechanism 22 is a fastener that connects to the removable upper 3. The removable upper 3 comprises a plurality of strap segments 31 and a plurality of connector inserts 32. The plurality of strap segments 31 is a collection of straps that is used to retain the user's foot within the sandal. The plurality of connector inserts 32 is a collection of fasteners that connect to the upper-connection mechanism. Preferably, the upper-fastening mechanism 22 is a magnet and each of the plurality of connector inserts 32 is composed of a ferromagnetic material so that each of the connector inserts can be magnetically coupled to a corresponding upper-fastening mechanism 22 from the plurality of strap-attachment couplers 2. In a preferred embodiment, each of the plurality of strap-attachment couplers 2 is a unibody receptacle that is integrated into the sandal sole 1, such that the opening of each of the plurality of strap-attachment couplers 2 traverses through a first face of the sandal sole 1. Preferably, each of the plurality of connector inserts 32 is designed as a unibody component. The unibody construction of the two components facilitates quickly coupling and decoupling the plurality of connector inserts 32 and the plurality of strap-attachment couplers 2.

Figure 4:
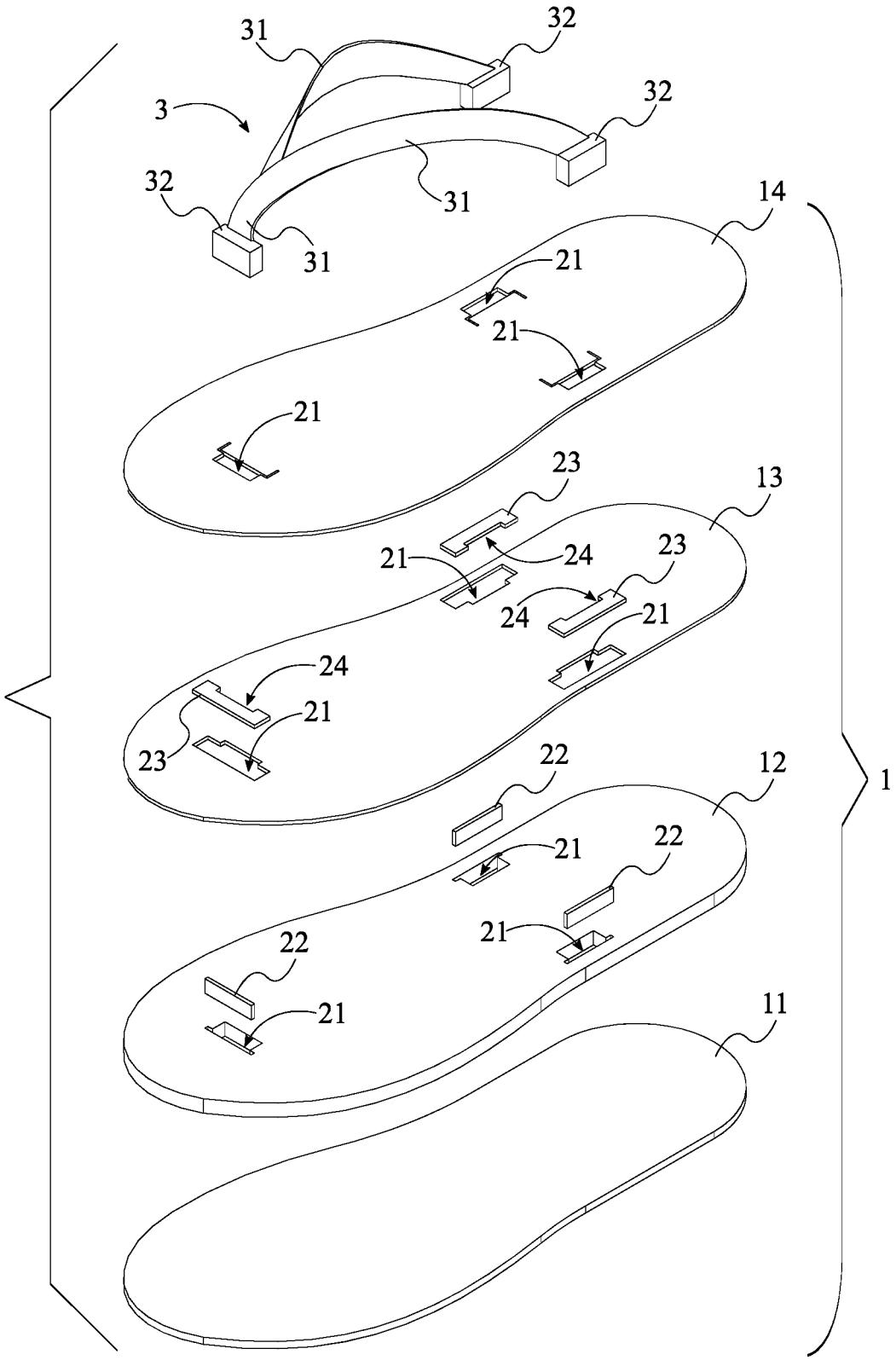
FIG. 4 is an exploded perspective view of the present invention.
Figure 5:
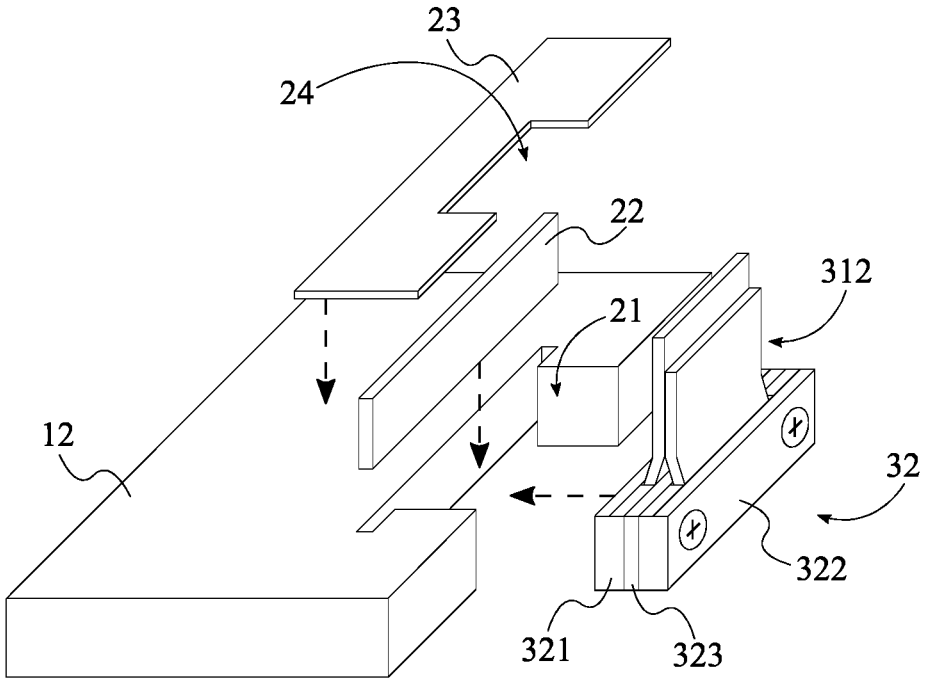
FIG. 5 is an exploded perspective view of the fastener mounting layer, a single strap-attachment coupler, and a s single connector insert used in the present invention.

Referring to FIG. 1, FIG. 4, FIG. 5, the connection between the removable upper 3 and the sandal sole 1 is established by coupling each of the plurality of connector inserts 32 with a corresponding attachment coupler 25 from the plurality of strap-attachment couplers 2. To accomplish this, the plurality of strap-attachment couplers 2 is distributed across the first face of the sandal sole 1 so that the plurality of strap segments 31 can be retained in a configuration that facilitates maintaining the user's foot within the sandal, comfortably. Expounding on the arrangement of the plurality of strap-attachment couplers 2, the connector-receiving receptacle 21 traverses into the sandal sole 1, normal to the first face. As a result, the connector inserts do not protrude past the first face and are prevented from damaging the user's foot. The upper-fastening mechanism 22 is laterally positioned to the connector-receiving receptacle 21. Additionally, the upper-fastening mechanism is integrated into the sandal sole 1. Consequently, the upper-fastening mechanism 22 retains the connector insert within the connector-receiving receptacle 21 until the user disengages the connection.

Referring to FIG. 1 and FIG. 5, the components of the removable upper 3 are arranged to facilitate providing a comfortable, function, and aesthetically pleasing sandal. To accomplish this, each of the plurality of connector inserts 32 is terminally connected to a corresponding strap 313 from the plurality of strap segments 31. Thus connected, each of the plurality of connector inserts 32 enables the corresponding strap 313 to be tethered to the sandal sole 1. Additionally, each of the plurality of connector inserts 32 is engaged within the connector-receiving receptacle 21 of a corresponding attachment coupler 25 from the plurality of strap-attachment couplers 2. Further, each of the plurality of connector inserts 32 is mechanically coupled to the upper-fastening mechanism 22 of the corresponding attachment coupler 25. As a result, the plurality of strap segments 31 is retained in a tethered configuration once the user inserts each of the plurality of connector inserts 32 into the corresponding coupler.

Referring to FIG. 1, FIG. 4, and FIG. 5, the Present invention is designed to create a stable connection between the removable upper 3 and the plurality of strap-attachment couplers 2 that persists until the user choses to disengage the connection. To facilitate this, each of the strap-attachment couplers 2 further comprises a connector-securing plate 23 and a strap-securing slot 24. The connector-securing plate 23 is a rigid plate that is used to prevent vertical motion of the connector insert that is engaged within the connector-receiving receptacle 21 of the corresponding attachment coupler 25. The connector-securing plate 23 is adjacently connected to the upper-fastening mechanism 22. Additionally, the connector-securing plate 23 is integrated into the sandal sole 1, adjacent to the connector-receiving receptacle 21. Further, the connector-receiving plate is positioned overlapping an opening of the connector-receiving receptacle 21. Thus positioned, the connector-securing plate 23 obscures a portion of the opening of the connector-receiving receptacle 21, forming a barrier that prevents the connector insert from inadvertently sliding out of the connector-receiving receptacle 21. In addition to forming a physical barrier over a portion of the connector-receiving receptacle 21, the connector-securing plate 23 works in concert with the upper-fastening mechanism 22 to retain the connector insert in a desired position within the connector-receiving receptacle 21. To accomplish this, the upper-fastening mechanism 22 is positioned in between the connector-securing plate 23 and a base of the connector-receiving receptacle 21. As a result, the connector-securing plate 23 presses the connector insert against the base of the connector-receiving receptacle 21 when the connector insert is coupled to the upper-fastening mechanism 22. The strap-securing slot 24 traverses normally through the strap-securing plate. Additionally, the strap-securing slot 24 is positioned along a first lengthwise edge of the strap-securing plate. Furthermore, the strap-securing slot 24 is positioned coincident with the opening of the connector-receiving receptacle 21. As a result, the strap-securing slot 24 forms an opening that enables the corresponding strap 313 to slide into a position where pulling on the corresponding strap 313 causes the connector insert to press against the connector-securing plate 23. More specifically, the position of the strap-securing slot 24 causes the tension on the corresponding strap 313 that is caused by the user's foot to be directed normal to the connector-securing plate 23. This prevents the tension in the corresponding strap 313 from pulling the connector insert away from the upper-fastening mechanism 22, and thus decoupling the connector insert from the upper-fastening mechanism 22.

Figure 2:
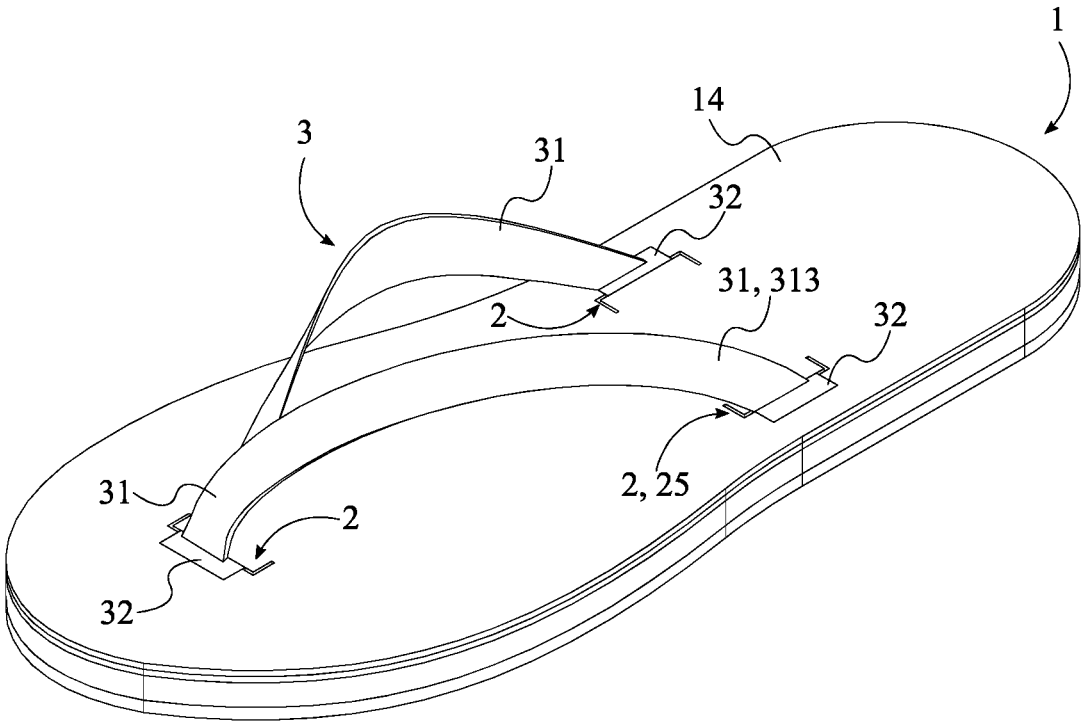
FIG. 2 is a perspective view of the present invention with the sandal sole being of multilayered construction.
Figure 3:
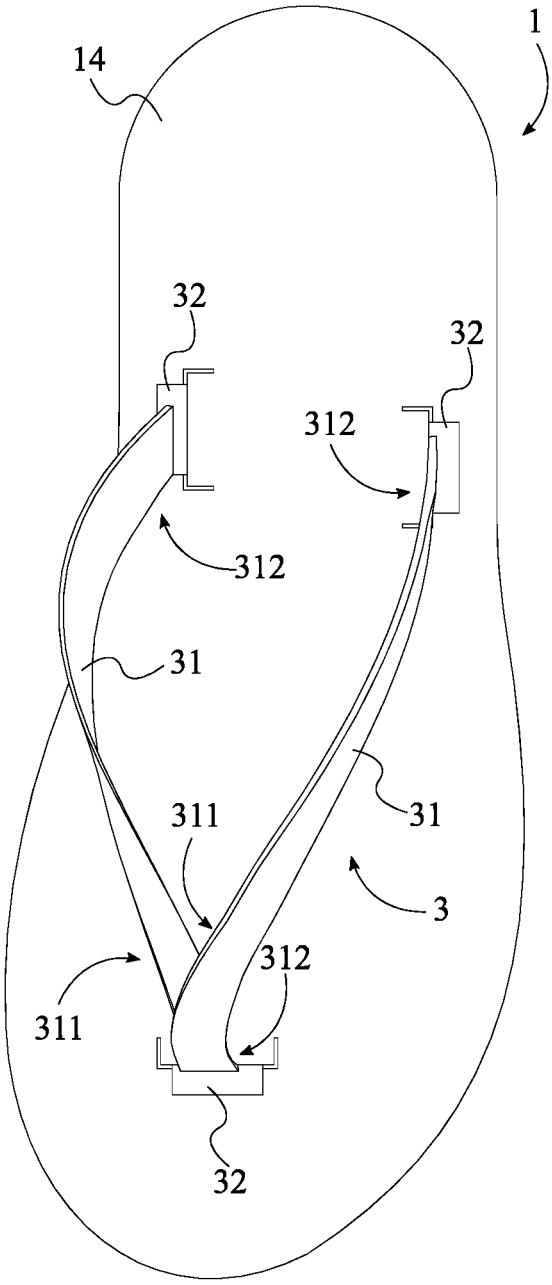
FIG. 3 is a top view of the present invention.

Referring to FIG. 2, FIG. 4, and FIG. 5, as described above, in as alternative embodiment the sandal sole 1 is a multilayered sole. The multilayered sole 1 is composed of multiple layers of material that are sandwiched together to create a sole that is comfortable, functional, and aesthetically pleasing. Specifically, the multilayered sole 1 comprises an outsole 11, a fastener-mounting layer 12, a plate-mounting layer 13, and an insole 14. The fastener-mounting layer 12 is superimposed onto the outsole 11. Additionally, the upper-fastening mechanism 22 is integrated into the fastener-mounting layer 12. Consequently, the fastener-mounting layer 12 is maintained in a position that facilitates retaining the upper-fastening mechanism 22 in a position that facilitates attaching the removable upper 3 to the multilayered sole 1. The plate-mounting layer 13 is superimposed onto the fastener-mounting layer 12, opposite to the outsole 11. Additionally, the connector-securing plate 23 is integrated into the plate-mounting layer 13. Accordingly, the plate-mounting layer 13 is maintained in a position that facilitates retaining the connector-securing plate 23 in a position that facilitates maintaining the connection between the removable upper 3 to the multilayered sole 1. The insole 14 is superimposed onto the plate-mounting layer 13, opposite to the fastener-mounting layer 12. Additionally, the first face is positioned opposite to the plate-mounting layer 13 across the insole 14. As a result, the user's foot rests on the first face while wearing the present invention. Further, the fastener-mounting layer 12 and the plate-mounting layer 13 are sandwiched between the outsole 11 and the insole 14. Moreover, the user's foot applies pressure to the insole 14 which aids in securing each of the plurality of connector inserts 32 within the corresponding attachment coupler 25. The connector-receiving receptacle 21 traverses normally through the insole 14, the plate-mounting layer 13, and the fastener-mounting layer 12. Consequently, the connector-receiving receptacle 21 enables the user to insert the connector insert into the multilayered sole 1 while preventing the connector insert from completely passing through the multilayered sole 1.

Referring to FIG. 1 and FIG. 4, the plurality of strap segments 31 is configured to create removable uppers 3 of varying shape and size. To facilitate this, each of the plurality of strap segments 31 comprises a first end 311 and a second end 312. Additionally, the first end 311 of each of the plurality of strap segments 31 is terminally connected to each other. As a result, the removable upper 3 can be constructed in configuration that include, but are not limited to, a Y-shaped thong, a single continuous band that is positioned over the user's foot, or a strap assembly that is positioned over the user's foot as well as wrapped around the user's heel. Each of the connector inserts is terminally connected the second end 312 of the corresponding strap 313 from the plurality of strap segments 31. Consequently, the second end 312 of the corresponding strap 313 is used to tether the removable upper 3 to the sandal sole 1 while the first end 311 is used to create the overall shape of the removable upper 3.

Figure 6:
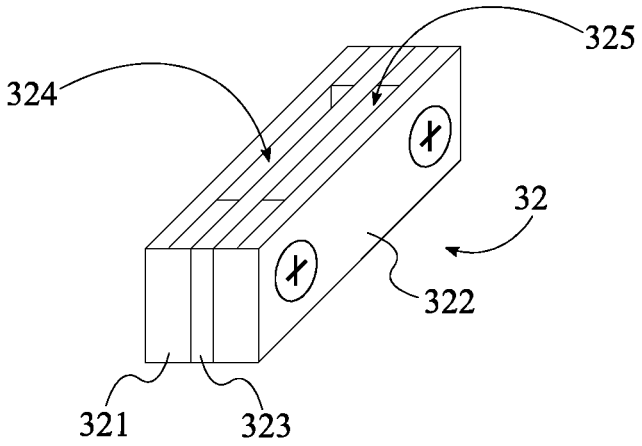
FIG. 6 is a perspective view of a single connector insert used in the present invention.
Figure 7:
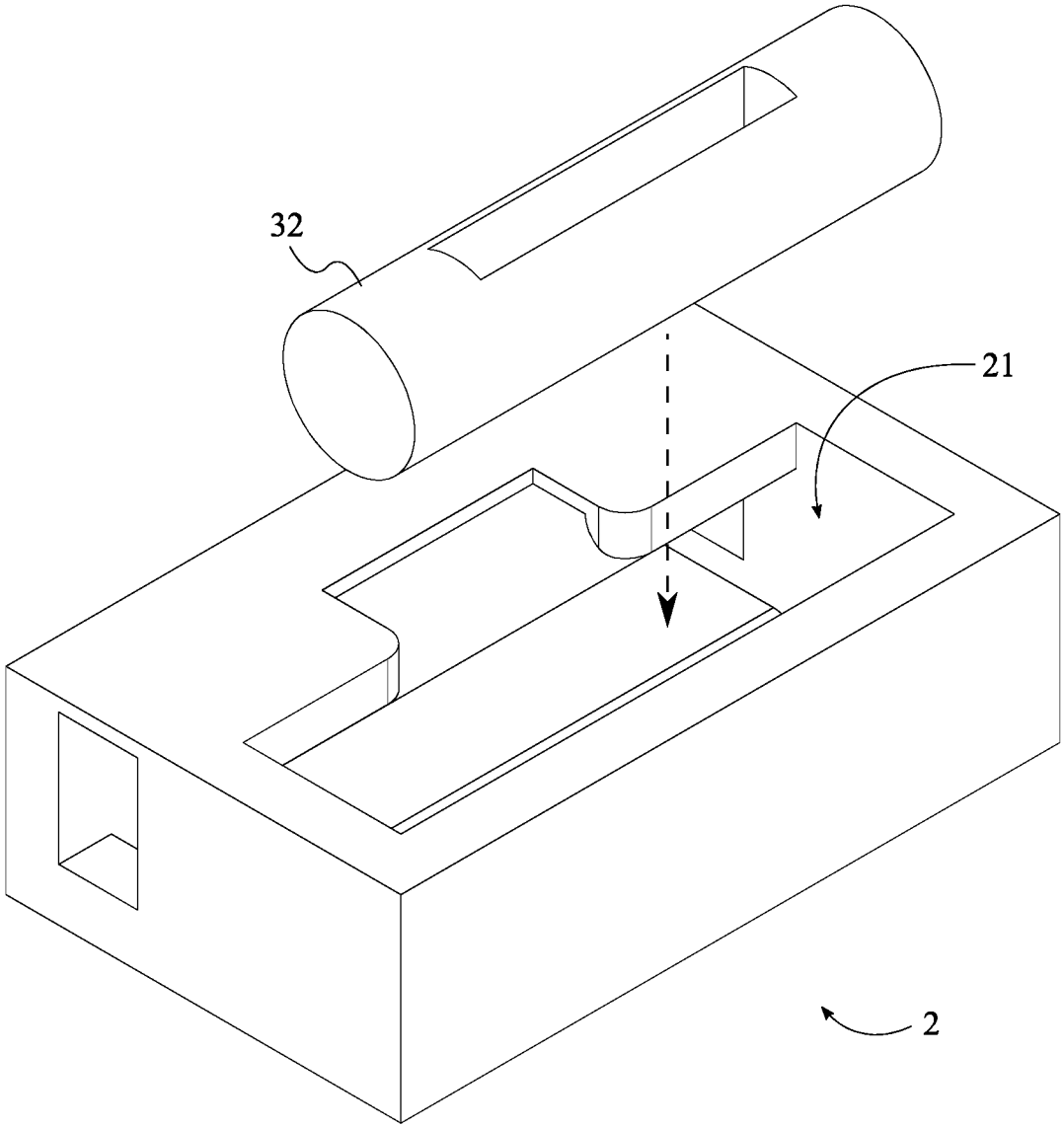
FIG. 7 is an exploded perspective view showing a unibody embodiment of a single strap-attachment coupler and a s single connector insert used in the present invention.

Referring to FIG. 1, FIG. 4, and FIG. 6, each of the plurality of connector inserts 32 is designed to attach to the second end 312 of the corresponding strap 313 in a manner that facilitates attaching the removable upper 3 to the sandal sole 1. To achieve this, each of the plurality of connector inserts 32 comprises a first plate 321, a second plate 322, a central plate 323, a first strap channel 324, and a second strap channel 325. The first plate 321, the second plate 322, and the central plate 323 are rigid members that are mounted onto the second end 312 of the corresponding strap 313. To further describe the arrangement, the first plate 321 is adjacently connected to the central plate 323. Additionally, the second plate 322 is adjacently connected to the central plate 323, opposite to the first plate 321. As a result, the first plate 321, the second plate 322, and the central plate 323 form a block that is shaped to be engaged into the connector-receiving receptacle 21. The first strap channel 324 traverses through the first plate 321. Additionally, first strap channel 324 is positioned adjacent to the central plate 323. Similar to the first strap channel 324, the second strap channel 325 traverses through the second plate 322. Further, the second strap channel 325 is positioned adjacent to the central plate 323. Moreover, the first strap channel 324 is positioned parallel to the second strap channel 325. As a result, the first strap channel 324 and the second strap channel 325 enable the second end 312 of the corresponding strap 313 to pass through the first plate 321 and the second plate 322. Finally, the corresponding strap 313 is looped through the first strap channel 324 and the second strap channel 325, about the central plate 323. Thus positioned, the second end 312 of the corresponding strap 313 is anchored to the connector insert.

Although the invention has been explained in relation to its preferred embodiment, it is to be understood that many other possible modifications and variations can be made without departing from the spirit and scope of the invention as hereinafter claimed.

What is claimed is:

1. A sandal with magnetically connected upper straps comprises:

a sandal sole;

a plurality of strap-attachment couplers;

a removable upper;

each of the plurality of strap-attachment couplers comprises a connector-receiving receptacle and an upper-fastening mechanism;

the removable upper comprises a plurality of strap segments and a plurality of connector inserts;

the plurality of strap-attachment couplers being distributed across a first face of the sandal sole;

the connector-receiving receptacle traversing into the sandal sole;

the upper-fastening mechanism being positioned to the connector-receiving receptacle;

the upper-fastening mechanism being integrated into the sandal sole;

each of the plurality of connector inserts being connected to a corresponding strap from the plurality of strap segments;

each of the plurality of connector inserts being engaged within the connector-receiving receptacle of a corresponding attachment coupler from the plurality of strap-attachment couplers;

each of the plurality of connector inserts being mechanically coupled to the upper-fastening mechanism of the corresponding attachment coupler;

each of the plurality of connector inserts comprises a first plate, a second plate, a central plate, a first strap channel, and a second strap channel;

the first plate being adjacently connected to the central plate;

the second plate being adjacently connected to the central plate, opposite to the first plate;

the first strap channel traversing through the first plate;

the first strap channel being positioned adjacent to the central plate;

the second strap channel traversing through the second plate;

the second strap channel being positioned adjacent to the central plate;

the first strap channel being positioned parallel to the second strap channel; and the corresponding strap being looped through the first strap channel and the second strap channel, about the central plate.

2. The sandal with magnetically connected upper straps as claimed in claim 1 comprises:

each of the plurality of strap-attachment couplers further comprises a connector-securing plate;

the connector-securing plate being adjacently connected to the upper-fastening mechanism;

the connector-securing plate being integrated into the sandal sole, adjacent to the connector-receiving receptacle;

the connector-receiving plate being positioned overlapping an opening of the connector-receiving receptacle; and the upper-fastening mechanism being positioned in between the connector-securing plate and a base of the connector-receiving receptacle.

3. The sandal with magnetically connected upper straps as claimed in claim 2 comprises:

each of the plurality of strap-attachment couplers comprises a strap-securing slot;

the strap-securing slot traversing through the strap-securing plate;

the strap-securing slot being positioned along a first lengthwise edge of the strap-securing plate; and the strap-securing slot being positioned coincident with the opening of the connector-receiving receptacle.

4. The sandal with magnetically connected upper straps as claimed in claim 1, wherein the upper-fastening mechanism is a magnet and each of the plurality of connector inserts is composed of a ferromagnetic material.

5. The sandal with magnetically connected upper straps as claimed in claim 1 comprises:

a connector-securing plate;

the sandal sole being a multilayered sole;

the multilayered sole comprises an outsole, a fastener-mounting layer, a plate mounting layer, and an insole;

the fastener-mounting layer being superimposed onto the outsole;

the upper-fastening mechanism being integrated into the fastener-mounting layer;

the plate-mounting layer being superimposed onto the fastener-mounting layer, opposite to the outsole;

the connector-securing plate being integrated into the plate-mounting layer;

the insole being superimposed onto the plate mounting layer, opposite to the fastener-mounting layer;

the first face being positioned opposite to the plate mounting layer across the insole; and the connector-receiving receptacle traversing through the insole, the plate-mounting layer, and the fastener-mounting layer.

6. The sandal with magnetically connected upper straps as claimed in claim 1 comprises:

each of the plurality of strap segments comprises a first end and a second end;

the first end of each of the plurality of strap segments being connected to each other; and each of the connector inserts being connected the second end of the corresponding strap from the plurality of strap segments.

7. The sandal with magnetically connected upper straps as claimed in claim 6, wherein the removable upper is Y-shaped.

8. A sandal with magnetically connected upper straps as claimed in claim 1, wherein the connector-receiving receptacle and the upper-fastening mechanism each being of unibody construction.

9. A sandal with magnetically connected upper straps comprises:

a sandal sole;

a plurality of strap-attachment couplers;

a removable upper;

each of the plurality of strap-attachment couplers comprises a connector-receiving receptacle, an upper-fastening mechanism, and a connector-securing plate;

the removable upper comprises a plurality of strap segments and a plurality of connector inserts;

each of the plurality of strap segments comprises a first end and a second end;

the plurality of strap-attachment couplers being distributed across a first face of the sandal sole;

the connector-receiving receptacle traversing into the sandal sole;

the upper-fastening mechanism being positioned to the connector-receiving receptacle;

the upper-fastening mechanism being integrated into the sandal sole;

each of the plurality of connector inserts being connected to a corresponding strap from the plurality of strap segments;

each of the plurality of connector inserts being engaged within the connector-receiving receptacle of a corresponding attachment coupler from the plurality of strap-attachment couplers;

each of the plurality of connector inserts being mechanically coupled to the upper-fastening mechanism of the corresponding attachment coupler;

the connector-securing plate being adjacently connected to the upper-fastening mechanism;

the connector-securing plate being integrated into the sandal sole, adjacent to the connector-receiving receptacle;

the connector-receiving plate being positioned overlapping an opening of the connector-receiving receptacle;

the upper-fastening mechanism being positioned in between the connector-securing plate and a base of the connector-receiving receptacle;

the first end of each of the plurality of strap segments being connected to each other;

each of the connector inserts being connected the second end of the corresponding strap from the plurality of strap segments;

each of the plurality of connector inserts comprises a first plate, a second plate, a central plate, a first strap channel, and a second strap channel;

the first plate being adjacently connected to the central plate;

the second plate being adjacently connected to the central plate, opposite to the first plate;

the first strap channel traversing through the first plate;

the first strap channel being positioned adjacent to the central plate;

the second strap channel traversing through the second plate;

the second strap channel being positioned adjacent to the central plate;

the first strap channel being positioned parallel to the second strap channel; and the corresponding strap being looped through the first strap channel and the second strap channel, about the central plate.

10. The sandal with magnetically connected upper straps as claimed in claim 9 comprises:

each of the plurality of strap-attachment couplers comprises a strap-securing slot;

the strap-securing slot traversing through the strap-securing plate;

the strap-securing slot being positioned along a first lengthwise edge of the strap-securing plate; and the strap-securing slot being positioned coincident with the opening of the connector-receiving receptacle.

11. The sandal with magnetically connected upper straps as claimed in claim 9, wherein the upper-fastening mechanism is a magnet and each of the plurality of connector inserts is composed of a ferromagnetic material.

12. The sandal with magnetically connected upper straps as claimed in claim 9 comprises:

a connector-securing plate;

the sandal sole being a multilayered sole;

the multilayered sole comprises an outsole, a fastener-mounting layer, a plate mounting layer, and an insole;

the fastener-mounting layer being superimposed onto the outsole;

the upper-fastening mechanism being integrated into the fastener-mounting layer;

the plate-mounting layer being superimposed onto the fastener-mounting layer, opposite to the outsole;

the connector-securing plate being integrated into the plate-mounting layer;

the insole being superimposed onto the plate mounting layer, opposite to the fastener-mounting layer;

the first face being positioned opposite to the plate mounting layer across the insole; and the connector-receiving receptacle normally traversing through the insole, the plate-mounting layer, and the fastener-mounting layer.

13. The sandal with magnetically connected upper straps as claimed in claim 9, wherein the removable upper is Y-shaped.

14. A sandal with magnetically connected upper straps comprises:

a sandal sole;

a plurality of strap-attachment couplers;

a removable upper;

each of the plurality of strap-attachment couplers comprises a connector-receiving receptacle, an upper-fastening mechanism, and a connector-securing plate;

the removable upper comprises a plurality of strap segments and a plurality of connector inserts;

each of the plurality of strap segments comprises a first end and a second end;

each of the plurality of connector inserts comprises a first plate, a second plate, a central plate, a first strap channel, and a second strap channel;

the plurality of strap-attachment couplers being distributed across a first face of the sandal sole;

the connector-receiving receptacle traversing into the sandal sole;

the upper-fastening mechanism being positioned to the connector-receiving receptacle;

the upper-fastening mechanism being integrated into the sandal sole;

each of the plurality of connector inserts being connected to a corresponding strap from the plurality of strap segments;

each of the plurality of connector inserts being engaged within the connector-receiving receptacle of a corresponding attachment coupler from the plurality of strap-attachment couplers;

each of the plurality of connector inserts being mechanically coupled to the upper-fastening mechanism of the corresponding attachment coupler;

the connector-securing plate being adjacently connected to the upper-fastening mechanism;

the connector-securing plate being integrated into the sandal sole, adjacent to the connector-receiving receptacle;

the connector-receiving plate being positioned overlapping an opening of the connector-receiving receptacle;

the upper-fastening mechanism being positioned in between the connector-securing plate and a base of the connector-receiving receptacle;

the first end of each of the plurality of strap segments being connected to each other;

each of the connector inserts being connected the second end of the corresponding strap from the plurality of strap segments;

the first plate being adjacently connected to the central plate;

the second plate being adjacently connected to the central plate, opposite to the first plate;

the first strap channel traversing through the first plate;

the first strap channel being positioned adjacent to the central plate;

the second strap channel traversing through the second plate;

the second strap channel being positioned adjacent to the central plate;

the first strap channel being positioned parallel to the second strap channel; and the corresponding strap being looped through the first strap channel and the second strap channel, about the central plate.

15. The sandal with magnetically connected upper straps as claimed in claim 14 comprises:

each of the plurality of strap-attachment couplers comprises a strap-securing slot;

the strap-securing slot traversing through the strap-securing plate;

the strap-securing slot being positioned along a first lengthwise edge of the strap-securing plate; and the strap-securing slot being positioned coincident with the opening of the connector-receiving receptacle.

16. The sandal with magnetically connected upper straps as claimed in claim 14, wherein the upper-fastening mechanism is a magnet and each of the plurality of connector inserts is composed of a ferromagnetic material.

17. The sandal with magnetically connected upper straps as claimed in claim 14 comprises:

a connector-securing plate;

the sandal sole being a multilayered sole;

the multilayered sole comprises an outsole, a fastener-mounting layer, a plate mounting layer, and an insole;

the fastener-mounting layer being superimposed onto the outsole;

the upper-fastening mechanism being integrated into the fastener-mounting layer;

the plate-mounting layer being superimposed onto the fastener-mounting layer, opposite to the outsole;

the connector-securing plate being integrated into the plate-mounting layer;

the insole being superimposed onto the plate mounting layer, opposite to the fastener-mounting layer;

the first face being positioned opposite to the plate mounting layer across the insole; and the connector-receiving receptacle traversing through the insole, the plate-mounting layer, and the fastener-mounting layer.

18. The sandal with magnetically connected upper straps as claimed in claim 14, wherein the removable upper is Y-shaped.

* * * * *